US007356300B2

(12) United States Patent
Kamiyama

(10) Patent No.: US 7,356,300 B2
(45) Date of Patent: Apr. 8, 2008

(54) IMAGE FORMING APPARATUS

(75) Inventor: Nobuto Kamiyama, Ryugasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 38 days.

(21) Appl. No.: 11/111,752

(22) Filed: Apr. 22, 2005

(65) Prior Publication Data

US 2005/0244203 A1 Nov. 3, 2005

(30) Foreign Application Priority Data

Apr. 28, 2004 (JP) ..... 2004-132605

(51) Int. Cl.
*G03G 15/20* (2006.01)

(52) U.S. Cl. ..... 399/341

(58) Field of Classification Search ..... 399/341, 399/410

See application file for complete search history.

(56) References Cited

U.S. PATENT DOCUMENTS

| | | | | |
|---|---|---|---|---|
| 4,985,733 | A | 1/1991 | Kurotori et al. | 355/282 |
| 5,099,289 | A | 3/1992 | Kurotori et al. | 355/290 |
| 5,842,104 | A | 11/1998 | Hazama et al. | 399/400 |
| 7,034,925 | B2 | 4/2006 | Kamiyama et al. | 355/407 |

FOREIGN PATENT DOCUMENTS

| | | | | |
|---|---|---|---|---|
| CN | 1175010 | | | 3/1998 |
| JP | 2-71286 | | | 3/1990 |
| JP | 6-258970 | | | 9/1994 |
| JP | 09006163 | A | * | 1/1997 |
| JP | 2000-75710 | | | 3/2000 |
| JP | 2001063890 | A | * | 3/2001 |
| JP | 2002-372882 | | | 12/2002 |
| JP | 2003-107978 | | | 4/2003 |
| JP | 2003107978 | A | * | 4/2003 |
| JP | 2003295742 | A | * | 10/2003 |
| JP | 2004-77857 | | | 3/2004 |
| JP | 2004170590 | A | * | 6/2004 |

OTHER PUBLICATIONS

Suzuki et al. (JP 2003-372882) JPO Machine Translation.*

* cited by examiner

*Primary Examiner*—David M. Gray
*Assistant Examiner*—Erika J. Villaluna
(74) *Attorney, Agent, or Firm*—Fitzpatrick, Cella, Harper & Scinto

(57) ABSTRACT

A temperature of a sheet material after passing a first fixing device and before entering a second fixing device changes between the start and the end of an image forming job, thus resulting in a change in the gloss of the toner image.

A cooling apparatus for directly or indirectly cooling the sheet material is provided in a conveying path 25 between the first fixing device 10 and the second fixing device 20 thereby suppressing a change in the image gloss between the start and the end of the image forming job.

11 Claims, 9 Drawing Sheets

IMAGE FORMING APPARATUS

BACKGROUND OF THE INVENTION

1. Field of the Invention

The present invention relates to an image forming apparatus employing an electrophotographic process, and more particularly to an image forming apparatus such as a copying machine, a printer, a facsimile and the like.

2. Related Background Art

In the prior image forming apparatus, it has been proposed to use two fixing devices in combination to improve the fixing property of a toner image to a recording material whenever the recording material is of a large heat capacity such as a thick paper (Japanese Patent Application Laid-Open No. H06-258970).

However, in image forming apparatus utilizing two fixing devices in combination, since a recording material heated in a first fixing device is heated again in a second fixing device, there may result a change in a gloss of the toner image on the recording material, resulting from a change in the temperature of the recording material immediately before entering the second fixing device.

For example, in the case of an image forming job that executes a heating process in continuation on plural recording material bearing toner images with a first fixing device and a second fixing device, a temperature of the recording material changes immediately before entering the second fixing device, between a recording material in an early stage of the image forming job and a recording material in a latter stage.

In an early stage of the image forming job, the recording material heated in the first fixing device enters the second fixing device in a state somewhat cooled by a conveying roller, a conveying guide plate and the like for conveying the recording material from the first fixing device to the second fixing device, but, in a latter stage of the image forming job, the recording material heated in the first fixing device enters the second fixing device without such cooling because the conveying roller, the conveying guide plate and the like are in an already heated state. Therefore, the temperature difference immediately prior to the entry into the second fixing device becomes 50° C. or more between the recording material in the early stage of the image forming job and that in the latter stage. As a result, even within a same continuous image forming job, a gloss of the image on the recording material changes by about 5-10 between the early state and the latter stage of the image forming job. Such large change in the image gloss leads to a deterioration of the image quality in the continuous image forming job.

SUMMARY OF THE INVENTION

An object of the present invention is to provide an image forming apparatus capable of suppressing a change in the gloss of the image.

Another object of the present invention is to provide an image forming apparatus capable of preventing a change in the gloss of the image.

The aforementioned objects can be attained, according to the present invention, by an image forming apparatus including:

image forming means which forms a toner image on a recording material;

first image heating means which heats the toner image on the recording material;

second image heating means which heats the toner image on the recording material, heated by the first image heating means;

conveying means which conveys the recording material, heated in the first image heating means, to the second image heating means; and cooling means which cools the recording material, heated in the first image heating means, prior to reaching the second image heating means.

According to the present invention, there is also provided an image forming apparatus including:

image forming means which forms a toner image on a recording material;

first image heating means which heats the toner image on the recording material;

second image heating means which heats the toner image on the recording material, heated by the first image heating means;

conveying means which conveys the recording material, heated in the first image heating means, to the second image heating means; and control means which controls a temperature of the recording material, after a heating process in the first image heating means and prior to a heating process in the second image heating means.

According to the present invention, there is further provided an image forming apparatus including:

image forming means which forms a toner image on a recording material;

first image heating means which heats the toner image on the recording material;

second image heating means which heats the toner image on the recording material, heated by the first image heating means;

conveying means which conveys the recording material, heated in the first image heating means, to the second image heating means; and heating means which heats the recording material, heated in the first image heating means, prior to reaching the second image heating means.

According to the present invention, there is further provided an image forming apparatus including:

image forming means which forms a toner image on a recording material;

first fixing means which fixes the toner image on the recording material;

second fixing means which fixes the toner image on the recording material, fixed by the first fixing means;

conveying means which conveys the recording material, fixed in the first fixing means, to the second fixing means; and cooling means which cools the recording material, fixed in the first fixing means, prior to reaching the second fixing means.

According to the present invention, there is further provided an image forming apparatus including:

image forming means which forms a toner image on a recording material;

first fixing means which fixes the toner image on the recording material;

second fixing means which fixes the toner image on the recording material, fixed by the first fixing means;

conveying means which conveys the recording material, fixed in the first fixing means, to the second fixing means; and control means which controls a temperature of the recording material, after a fixing process in the first fixing means and prior to a fixing process in the second fixing means.

According to the present invention, there is further provided an image forming apparatus including:

image forming means which forms a toner image on a recording material;

first fixing means which fixes the toner image on the recording material;

second fixing means which fixes the toner image on the recording material, fixed by the first fixing means;

conveying means which conveys the recording material, fixed in the first fixing means, to the second fixing means; and heating means which heats the recording material, fixed in the first fixing means, prior to reaching the second fixing means.

DETAILED DESCRIPTION OF THE PREFERRED EMBODIMENTS

In the following, there will be explained best mode for executing the present invention.

First Embodiment

Figure 1:
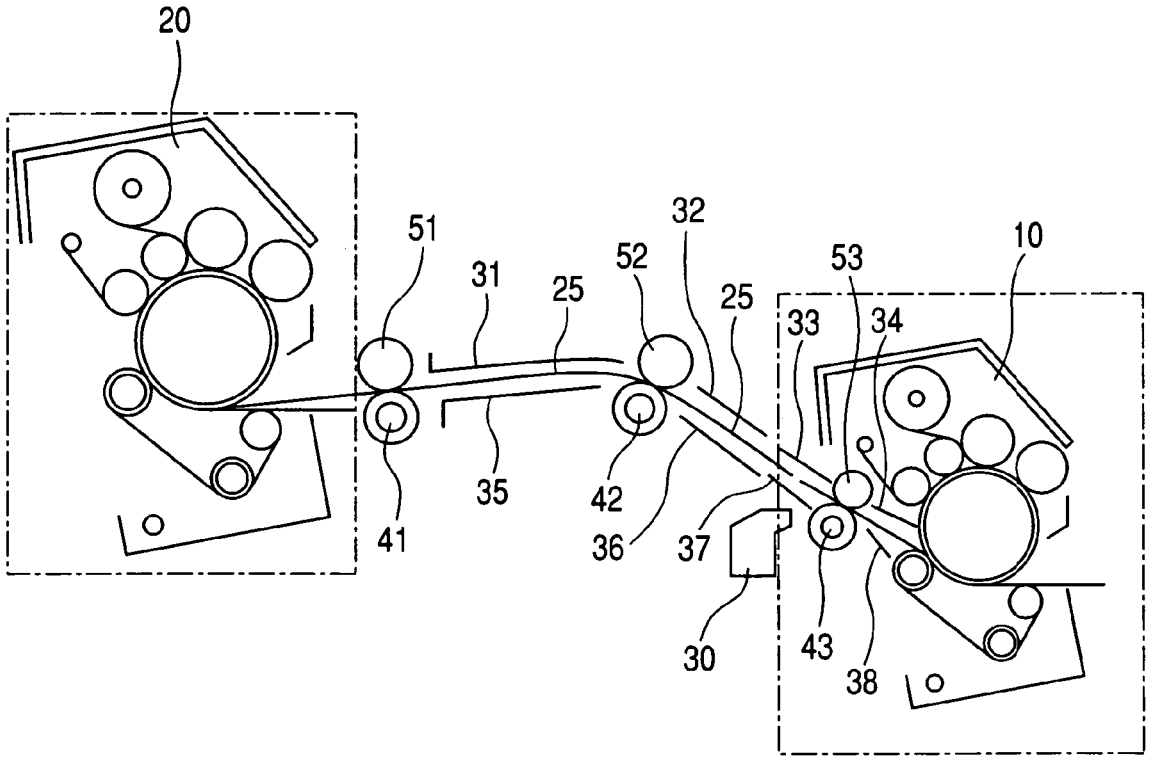
FIG. 1 is a schematic cross-sectional view of a fixing portion of an image forming apparatus.

FIG. 1 is a cross-sectional view of a fixing apparatus of the present invention, adapted for use in an image forming apparatus such as a copying apparatus or a printer.

Such image forming apparatus is provided with an image forming portion for forming a toner image on a sheet material 100 such as paper of an OHP sheet as the recording material, and a fixing apparatus for heat fixing the toner image on the sheet material.

The image forming portion as image forming means has such a configuration of forming a desired electrostatic latent image on a photosensitive member as a image bearing member, developing such electrostatic latent image on the photosensitive member with a toner in a developing apparatus, then conveying a sheet material in a cassette by a conveying roller or the like so as to be synchronized with the toner image on the photosensitive member and transferring such toner image onto the sheet material by a transfer apparatus.

A fixing apparatus as image heating apparatus is provided, as shown in FIG. 1, with a first fixing device 10 as first image heating means, and a second fixing device 20 as second image heating means.

The sheet material bearing the toner image formed in the image forming portion is conveyed to the first fixing device 10, and the sheet material subjected to a heating process (fixed) in the first fixing device 10 is conveyed to a sheet discharge portion provided in the first fixing device 10 and constituted of plate-shaped sheet discharge guides 34, 38 (guide members), sheet discharge rollers 43, 53 and plate-shaped sheet discharge guides 33, 37 (guide members) serving as conveying means.

Figure 2:
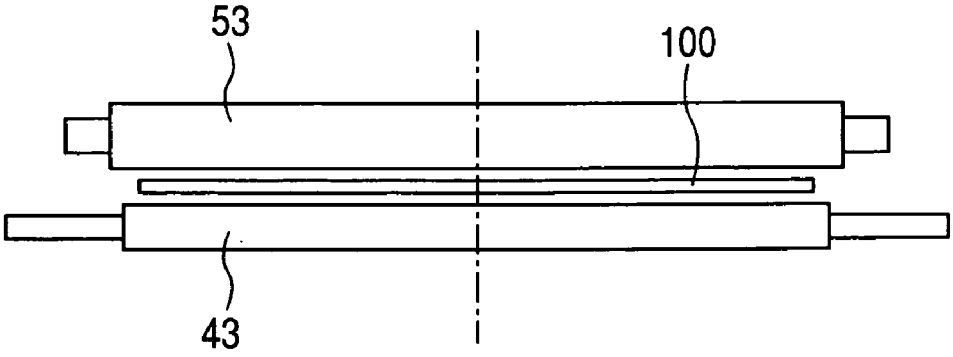
FIG. 2 is a cross-sectional view of a conveying roller.

The sheet discharge rollers 43, 53 have a nip wider than a maximum width of the sheet material as shown in FIG. 2.

The sheet material discharged from the first fixing device passes a sheet discharge portion, and conveyed to a sheet material conveying path 25 constituting conveying means provided in a downstream side in the conveying direction of the sheet material and formed by plate-shaped conveying guides 32, 36 (guide members), conveying rollers 42, 52, 41, 51 and plate-shaped conveying guides 31, 35 (guide members).

Also such paired conveying rollers (42 and 52, 41 and 51) have a nip width wider than the maximum width of the sheet material, as shown in FIG. 2.

Also between the paired conveying rollers 42, 52 and the paired conveying rollers 43, 53, and under the sheet discharge guide 37, there is provided a duct 30 as cooling means for cooling the sheet material heated in the first fixing device (control means which controls the temperature of the sheet material within a predetermined temperature range.

Figure 3:
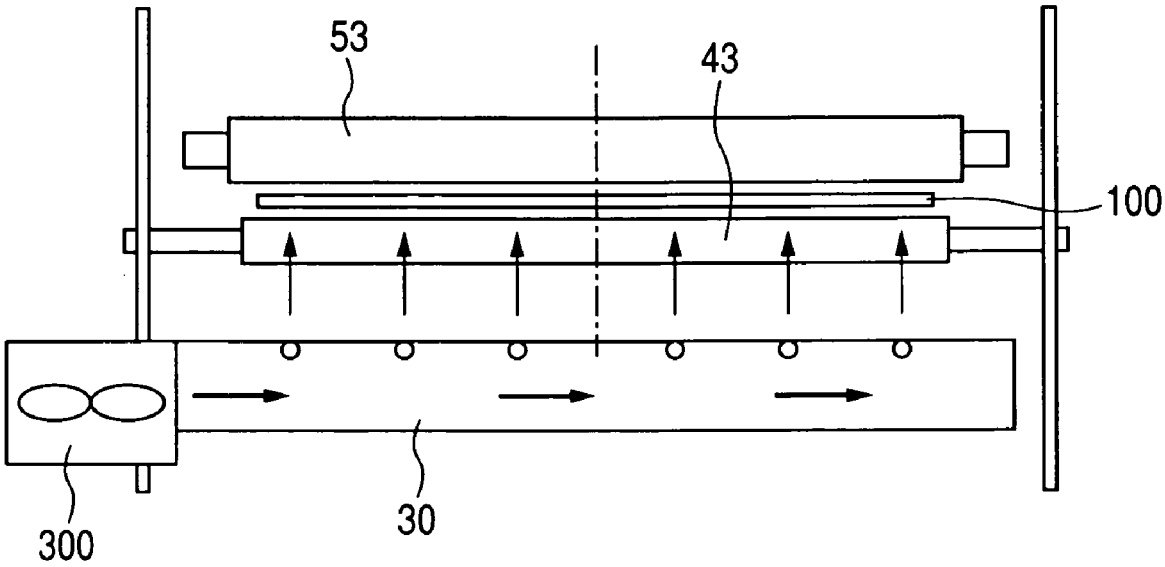
FIG. 3 is a schematic view of a cooling duct in first and third embodiments.

The duct 30 is so constructed, as shown in FIG. 3, as to blow air from a fan 300 to the conveying roller substantially uniformly over the longitudinal direction thereof.

Figure 4:
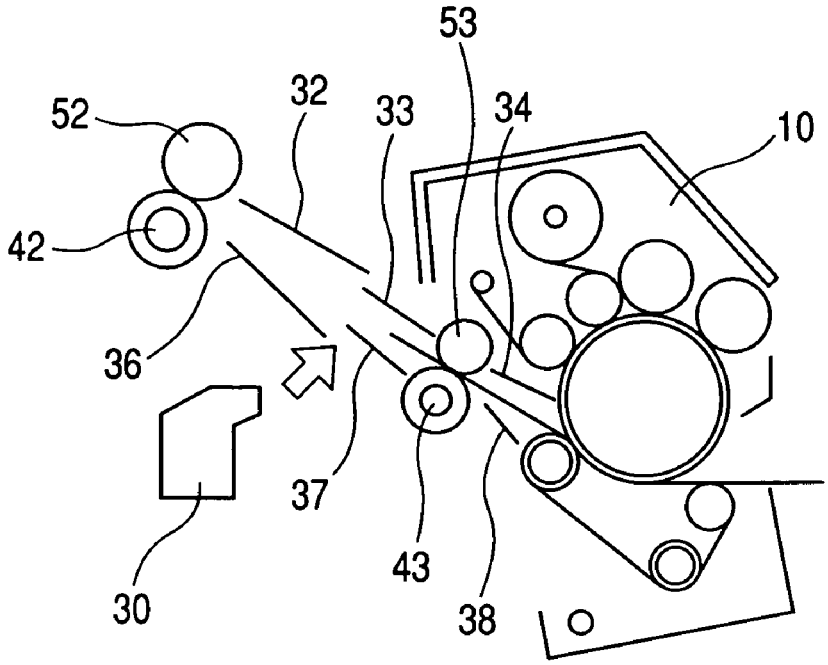
FIG. 4 is a schematic view showing a first fixation and an internal sheet discharge in a first embodiment.
Figure 5:
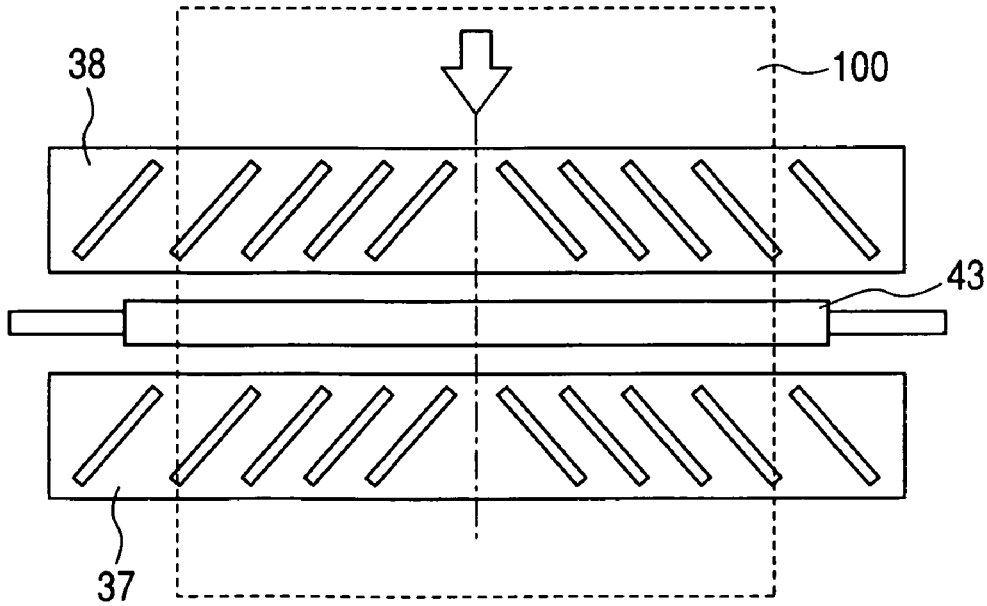
FIG. 5 is a detailed view of an internal sheet discharge guide member in first and third embodiments.

As shown in FIG. 4, the air is blown from the duct 30 toward the sheet discharge guide 37.

The sheet discharge guides 33, 34, 37, 38 are provided with through holes (hereinafter represented as slits) in order that the air directly contacts the passed sheet material. Such structure allows the passed sheet material 100 to be effectively cooled by the air emitted from the duct 30.

The through holes need not necessarily formed as slits but may be constituted of a plurality of simple holes. Also in case the through holes are formed as slits, they may be formed in any direction as long as the sheet material can be cooled, but they are preferably formed in a direction inclined with respect to the conveying direction of the sheet material, in consideration of the stability of conveying, namely in order that the sheet material is not hooked by the slits in the conveying.

In the present embodiment, when a continuous image forming job is initiated for executing a heating process (fixing process) continuously on plural recording materials, the fan of the duct 30 is not activated until a 30th sheet passing through the first fixing device but is activated from a 31st sheet and is maintained active until the end of the image forming job.

Figure 6:
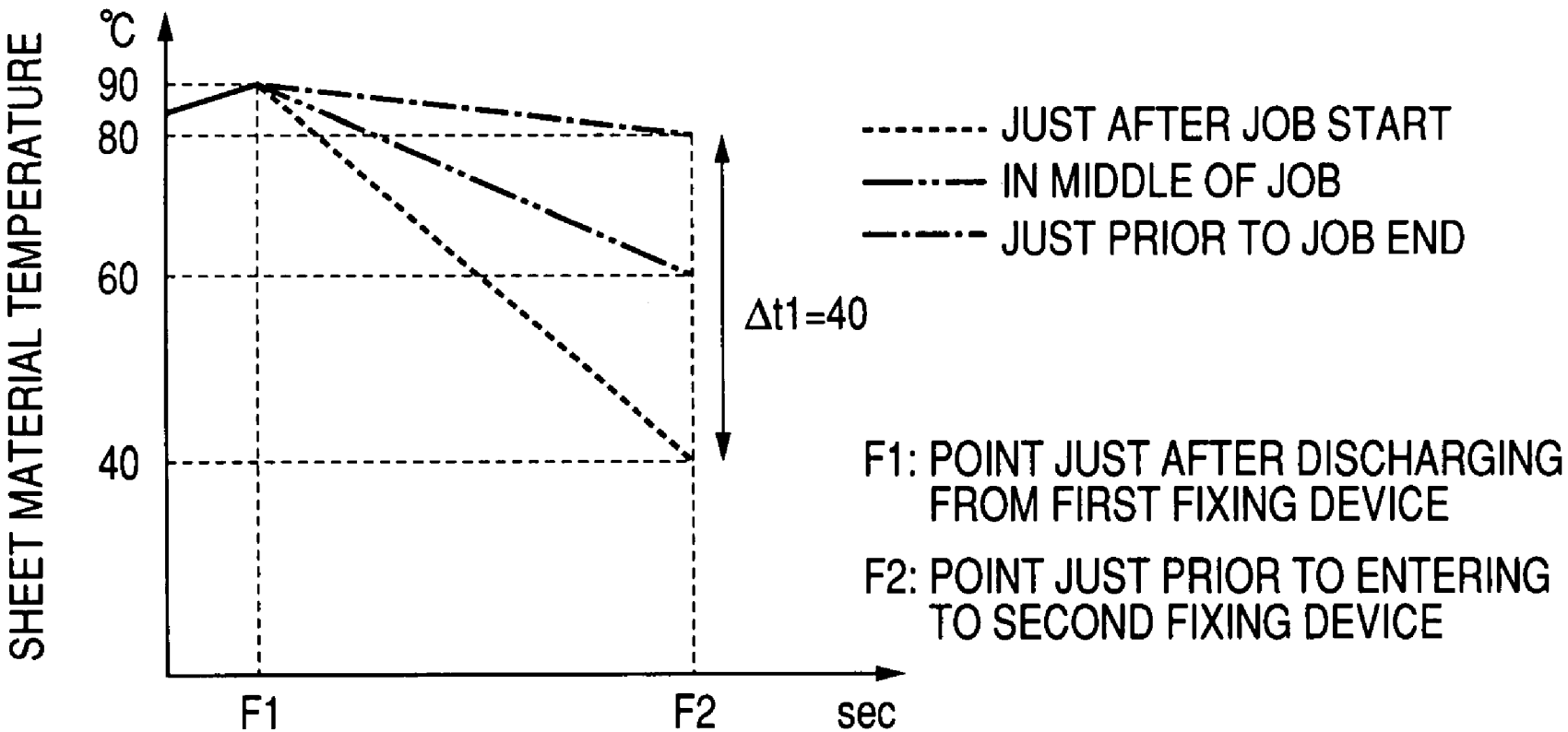
FIG. 6 is a graph showing a change in a temperature of a sheet material (without temperature control means)

FIG. 6 shows a change of the temperature of the sheet from the start of a continuous image forming job to the end thereof, in a prior configuration in which, different from the above-described configuration, the sheet material discharged from the first fixing device is not cooled. F1 indicates a timing immediately after discharging from the first fixing device, and F2 indicates a timing immediately before entry into the second fixing device.

The sheet material 100 is discharged in a state of about 90° C. from the first fixing device, then passes the conveying path 25 and is conveyed to the second fixing device 20.

A temperature of the sheet material conveying mechanism provided in the conveying path 25 (sheet discharge guides, sheet discharge rollers, conveying rollers and conveying guides) is approximately room temperature immediately after the start of a continuous image forming job, and the sheet material heated in the first fixing device is subjected to a heat dissipation to the sheet material conveying mechanism (sheet discharge guides, sheet discharge rollers, conveying rollers and conveying guides) and conveyed, in a state cooled from about 90° C. to about 40° C., to the second fixing device 20.

Thereafter, with the progress of the image forming job, the sheet material conveying mechanism (sheet discharge guides, sheet discharge rollers, conveying rollers and conveying guides) is heated and reaches a state incapable of taking away a large amount of heat from the sheet material heated in the first fixing device.

Thus, immediately prior to the end of the image forming job, the sheet material discharged at 90° C. is only cooled to about 80° C. and is conveyed to the second fixing device 20.

In this case, a temperature difference Δt1 of the sheet material entering the second fixing device becomes as large as 40° C. between the initial stage and the latter stage of the continuous image forming job, thus resulting in a large change in the gloss of the toner image fixed on the sheet material. More specifically, the gloss change ΔG1 of the toner image becomes as large as about 8.

Thus, in the prior case where the sheet material is not cooled (not temperature controlled), the gloss change of the toner image becomes as large as 5-10, whereby the gloss of the image varies significantly between the initial stage and the latter stage even within a single continuous image forming job, thus causing a problem in the image quality.

Figure 7:
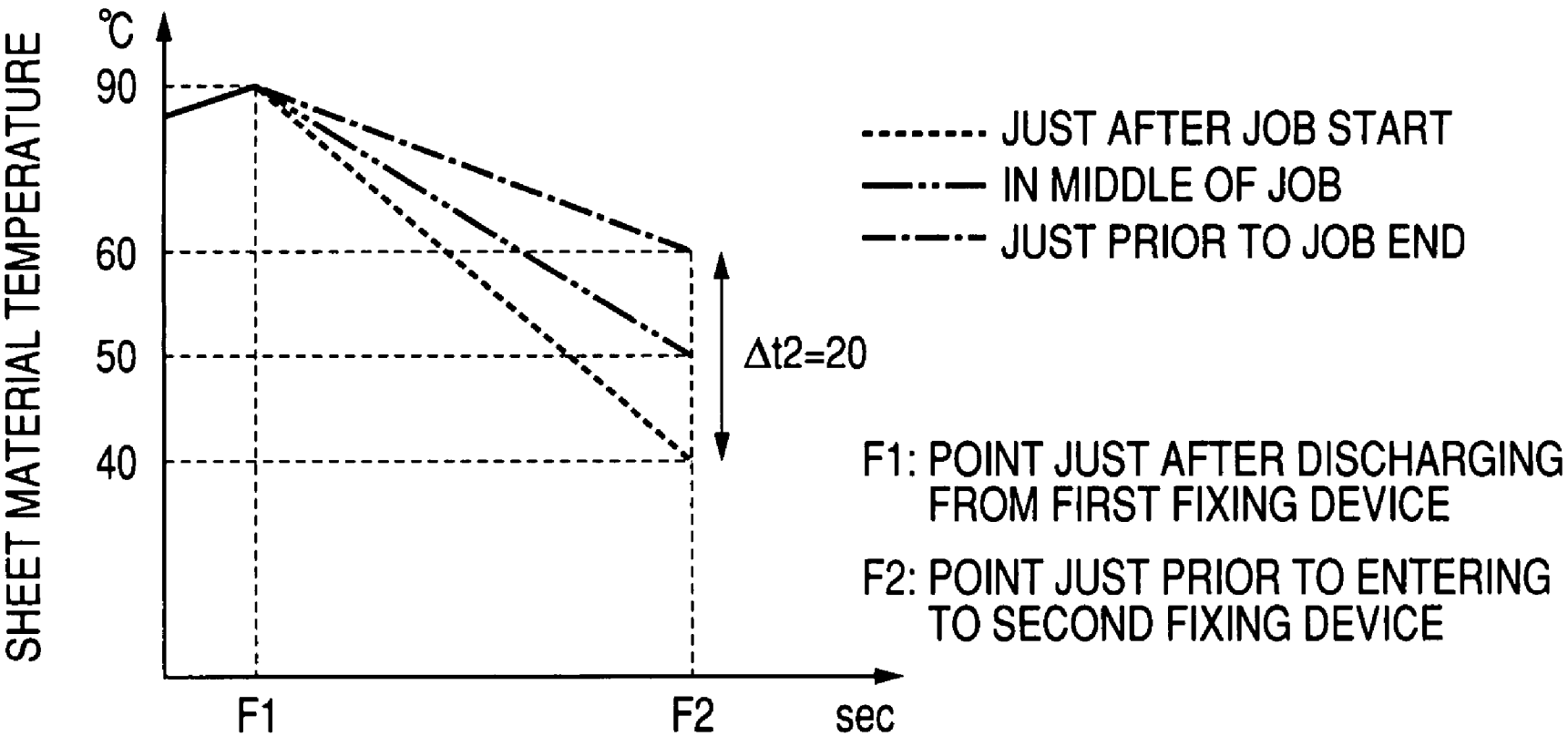
FIG. 7 is a graph showing a change in a temperature of a sheet material (with temperature control means)

FIG. 7 shows a change of the temperature of the sheet material from the start of a continuous image forming job to the end thereof, in case the sheet material is subjected to a cooling (temperature control) in the configuration of the present invention.

As in FIG. 6, F1 indicates a timing immediately after discharging from the first fixing device, and F2 indicates a timing immediately prior to entry into the second fixing device.

A temperature of the sheet material conveying mechanism provided in the conveying path 25 (sheet discharge guides, sheet discharge rollers, conveying rollers and conveying guides) is approximately room temperature immediately after the start of a continuous image forming job, and the sheet material heated in the first fixing device is subjected to a heat dissipation to the sheet material conveying mechanism (sheet discharge guides, sheet discharge rollers, conveying rollers and conveying guides) and conveyed, in a state cooled from about 90° C. to about 40° C., to the second fixing device 20.

Thereafter, when the continuous image forming job proceeds to a point where 30 sheets have been passed, the sheet material reaches a temperature of about 60° C. At this point, the fan 300 is activated to start the aforementioned cooling step for the sheet material conveying mechanism, thereby executing a cooling step for the sheet material.

It is thus possible to suppress a temperature increase in the sheet material, by cooling the sheet material discharged at about 90° C. from the first fixing device, through blowing air to the sheet material conveying mechanism, or the sheet discharge guide and the sheet material in this embodiment, whereby the temperature of the sheet material at immediately before the end of the continuous image forming job (at a timing F2) can be maintained at about 60° C. Thus in the present embodiment, the temperature of each recording material at a timing F2 within the continuous image forming job is controlled within a predetermined temperature range.

In this case, the temperature difference Δt2 of the sheet material entering the second fixing device becomes about 20° C. between the initial stage and the latter stage of the continuous image forming job, thus suppressing the gloss change ΔG2 of the toner image to about 3 between the initial stage and the latter stage of the continuous image forming job. It is thus possible to maintain the gloss of the toner image on each sheet material within the single continuous image forming job within a desired range, thereby suppressing a loss in the image quality. According to an investigation by the present inventors, it is identified that an image quality standard can be satisfied in case Δt2 is 30° C. or less.

In the present embodiment, it is rendered possible, by selecting a sheet cooling position at an upstream side position within the conveying path 25, more specifically at a sheet position immediately after the discharge from the first fixing device, to effectively suppress a further temperature increase in the sheet material conveying mechanism provided at the downstream side in the sheet conveying direction.

Figure 8:
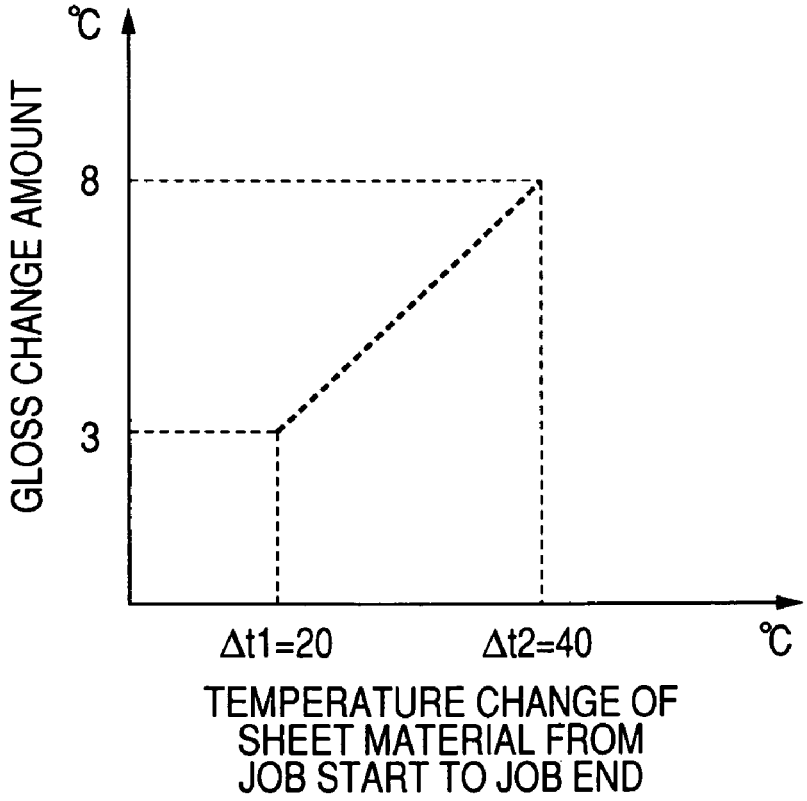
FIG. 8 is a graph showing an amount of change in image gloss.

FIG. 8 shows changes in temperature and gloss of the sheet material from the start of a continuous image forming job to the end thereof.

In the foregoing there has been explained a case of starting a cooling/temperature control of the sheet material after passing 30 sheets from the start of the continuous image forming job, utilizing a thick paper of a basis weight of 105 g/m$^2$ as the sheet material, but, in case of a job utilizing an even thicker paper as the sheet material, the cooling/temperature control of the sheet material is preferably started at an earlier stage, for example after passing 20 sheets in a continuous image forming job, in consideration of the heat capacity of the sheet material.

Inversely, in case of a job utilizing a thinner paper, the timing of starting the cooling/temperature control of the sheet material is preferably delayed, based on the heat capacity of the sheet material. Thus it is preferable to suitably set the start timing of the cooling for the sheet material according to a thickness and a type of the sheet material.

Also in the foregoing description, the change in the image gloss is suppressed by starting the cooling of the sheet discharge guide or the sheet material from an interim timing of the continuous image forming job, but there can also be adopted a following configuration.

It is also possible, for example from the start of the continuous image forming job, to apply warm air from the duct to the sheet discharge guide and the sheet material, thereby warming the sheet discharge guide and the sheet material in advance. Thus there can be suppressed a change in the temperature of the sheet discharge guide and the sheet material from the start of the continuous image forming job to the end thereof, and a change in the gloss of the image.

The temperature and the gloss change of the sheet material in the present embodiment are mere embodiments and may vary according to a temperature control condition of the fixing device, an ambient temperature and an ambient humidity.

Also air is employed as means which cools (or heats) the sheet material, but other cooling (or heating) means may be employed as long as the sheet material can be cooled (or heated).

Second Embodiment

In the following there will be explained a second embodiment of the present invention, in which configurations, except for a configuration for cooling the sheet material, are similar to those in the first embodiment, and will not therefore be explained in detail. In the present embodiment, the sheet material conveying mechanism is cooled to indirectly cool the sheet material.

Figure 9:
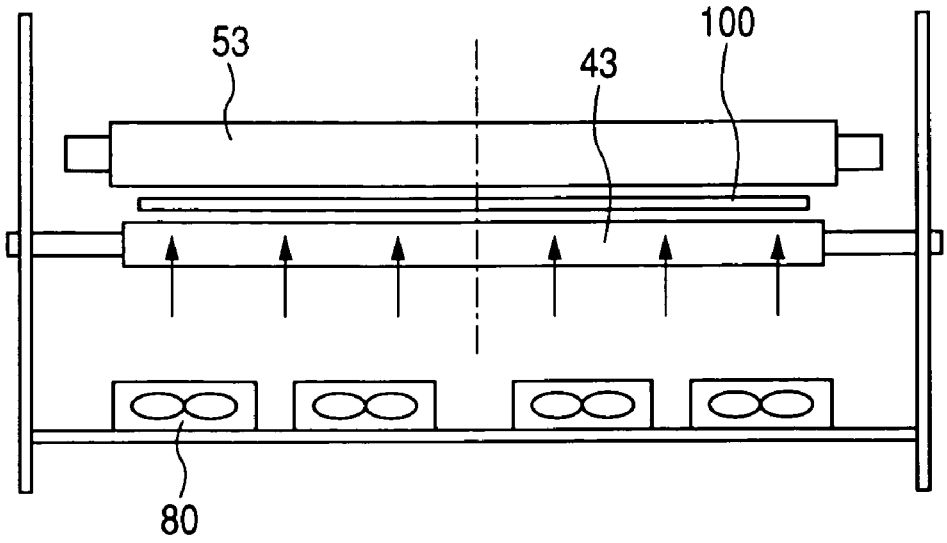
FIG. 9 is a schematic view showing temperature control fans in second and fifth embodiments.
Figure 10:
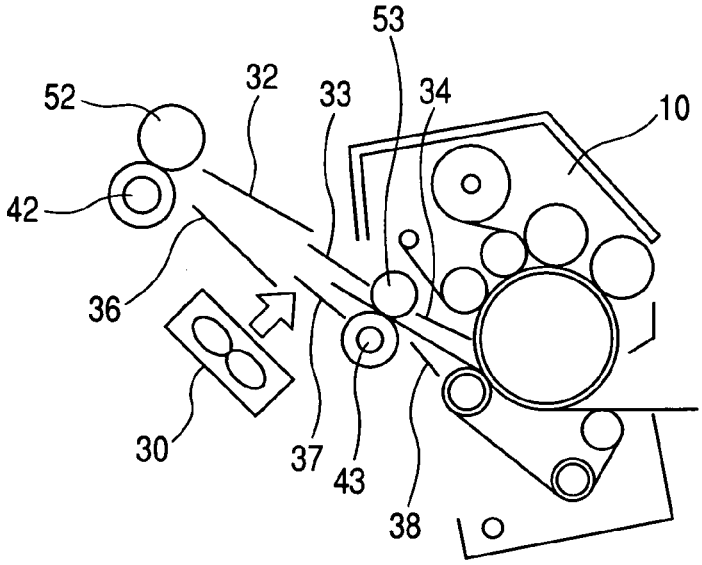
FIG. 10 is a schematic view showing a first fixation and an internal sheet discharge in a second embodiment.

In this embodiment, as shown in FIG. 9, plural fans 80 are provided below the conveying path 25 and along a direction of width of the sheet material. A cooling flow (air) from the fans 80 is blown, through the duct 30, toward the sheet discharge guide 37 from below the conveying path 25 as shown in FIG. 10.

In the first embodiment, as the sheet discharge guide 37 is provided with slits, the air is blown to the sheet material as well as the sheet discharge guide, thereby suppressing (controlling) the temperature at the entry into the second fixing device.

In the present embodiment, the sheet discharge guide 37 is cooled by the fans to suppress a temperature rise thereof (namely controlling the temperature thereof). Such configuration, as in the first embodiment, allows to maintain a constant heat amount taken away by the sheet discharge guide from the sheet material discharged at about 90° C. from the first fixing device, thereby reducing the temperature difference in the sheet materials conveyed to the second fixing device 20.

Figure 11:
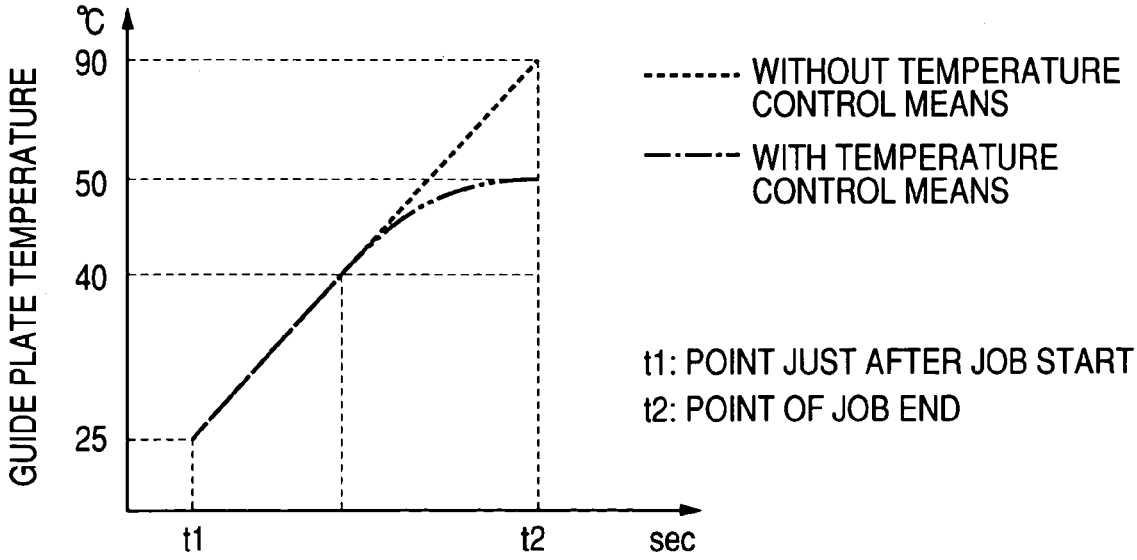
FIG. 11 is a graph showing a change in a temperature of a guide plate.

FIG. 11 shows a temperature change in the sheet discharge guide 37. As illustrated, the temperature of the sheet discharge guide during the job can be maintained by the cooling means for the sheet material within a predetermined temperature range, thereby providing a similar effect as in the first embodiment.

Third Embodiment

In the following there will be explained a third embodiment of the present invention, in which configurations, except for a configuration for cooling the sheet material, are similar to those in the first embodiment, and will not therefore be explained in detail. In the present embodiment, air is blown directly to the sheet material from a toner image bearing side thereof, thereby cooling the sheet material.

Figure 12:
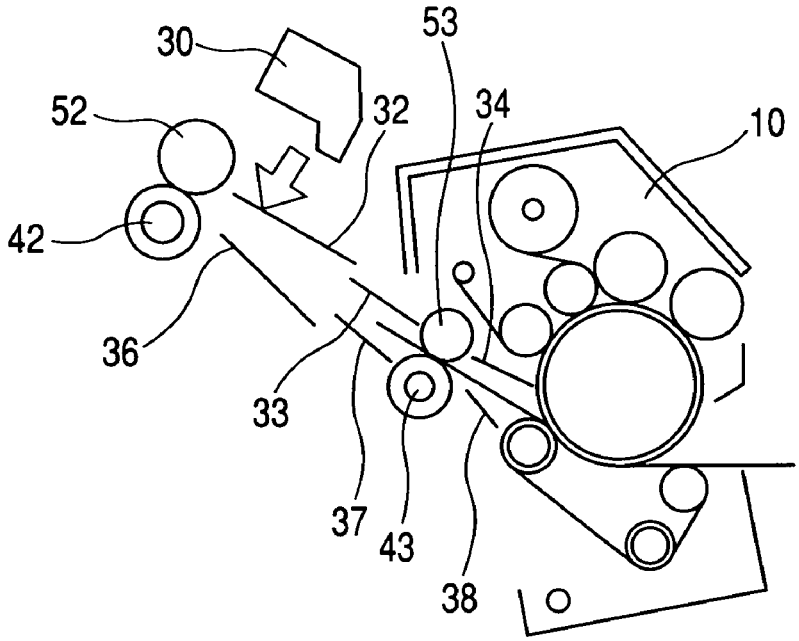
FIG. 12 is a schematic view showing a first fixation and an internal sheet discharge in a third embodiment.

In the present embodiment, there are provided a fan 300 and a duct 30 similar to those in the first embodiment, and, as shown in FIG. 12, the duct 30 is provided above the conveying path 25.

Also the conveying guide 32 in the conveying path 25 is provided with slits similar to those in the first embodiment.

In such configuration, the air from the fan 300 is blown through the duct 30, from above the conveying path 25, to the toner image bearing surface of the sheet material, thereby directly cooling the sheet material.

Such configuration for directly cooling the toner image bearing surface of the sheet material allows to prevent a sticking of the toner of the sheet material, conveyed to the conveying path 25, to the conveying guide and also to obtain effects similar to those in the first embodiment.

Fourth Embodiment

In the following there will be explained a fourth embodiment of the present invention, in which configurations, except for a configuration for cooling the sheet material, are similar to those in the first embodiment, and will not therefore be explained in detail. In the present embodiment, the sheet material is cooled with a water-cooling mechanism.

Figure 13:
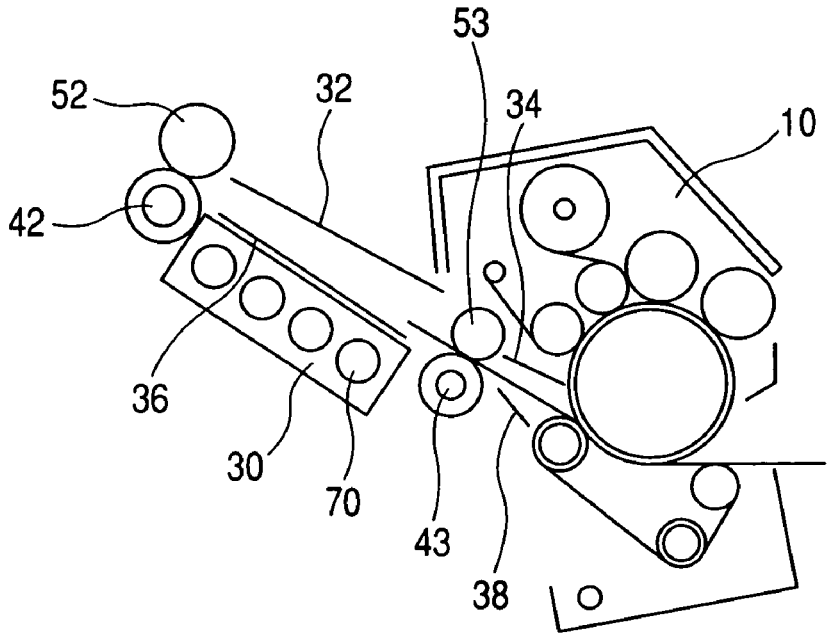
FIG. 13 is a schematic view showing a first fixation and an internal sheet discharge in a fourth embodiment.

In the fourth embodiment, in an image forming apparatus of a structure similar to those in the foregoing embodiments, a water-cooling mechanism as cooling means (temperature control means) is provided under the conveying guide 36 of the conveying path 25, as shown in FIG. 13.

The water-cooling mechanism is constituted of a pipe 70 constituting a water path in the duct 30 and a circulation pump P for circulating cooling water in the pipe 70, and the cooling water is circulated to obtain a cooling effect in continuous manner. In order that the conveying guide 36 is cooled by a cooled atmosphere in the duct 30, the duct 30 is positioned very close to the conveying guide 36. It is naturally possible also to blow the cooled air in the duct 30 toward the conveying guide 36 with a fan as in the first embodiment.

The circulation pump P is controlled by a control apparatus, and is turned on in a cooling state (after passing 30 sheets in a continuous job), and is turned off in a non-cooling state (before passing 30 sheets in a continuous job).

Figure 14:
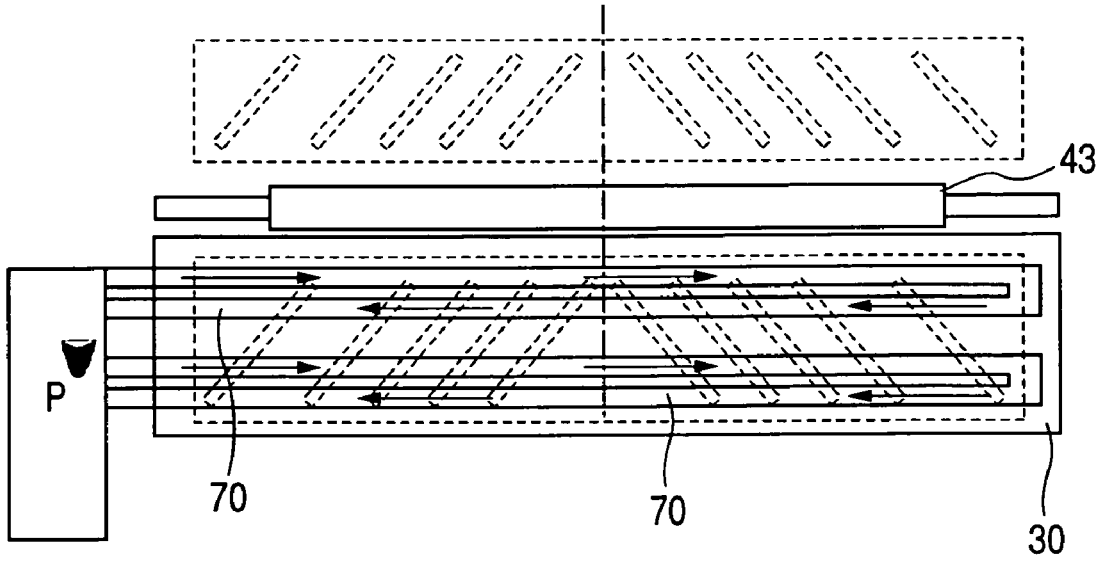
FIG. 14 is a schematic view of a pipe and a pump in a fourth embodiment.

FIG. 14 is a detailed view of the water-circulating apparatus, in which a water circulating path and a circulating direction are indicated by arrows. Such configuration also allows to obtain effects similar to those in the first embodiment.

Also as a variation of the water-cooling mechanism, it is possible to dispense with the duct 30 and to position the pipe 70 in direct contact with the conveying guide 36 thereby achieving a more efficient cooling.

Fifth Embodiment

In the following there will be explained a fifth embodiment of the present invention, in which configurations, except for a configuration for cooling the sheet material, are similar to those in the first embodiment, and will not therefore be explained in detail. In the present embodiment, the conveying roller is cooled instead of the guide thereby indirectly cooling the sheet material.

Figure 15:
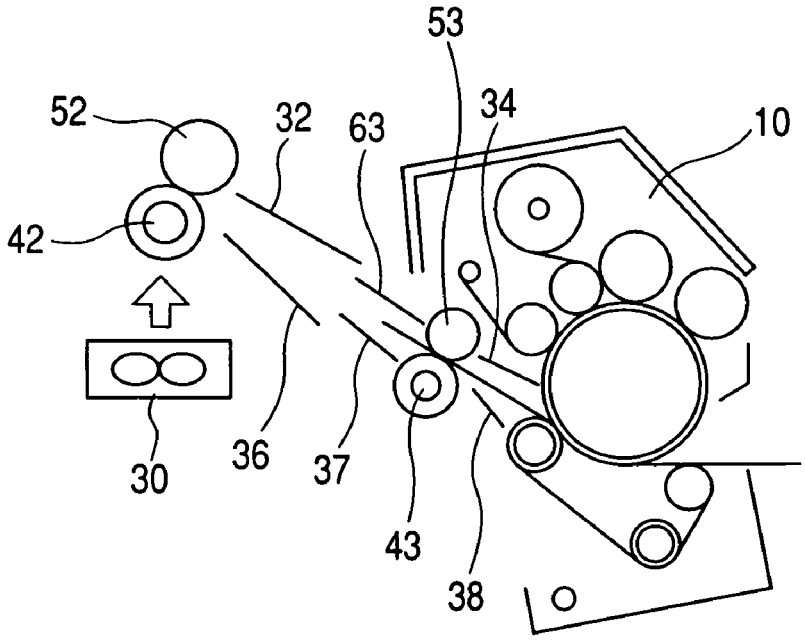
FIG. 15 is a schematic view showing a first fixation and an internal sheet discharge in a fifth embodiment.

In the present embodiment, as shown in FIG. 15, a conveying roller 42 positioned between the first fixing device 10 and the second fixing device 20 is cooled. The conveying roller 42 is formed by a hollow metal roller.

Air from the fan is blown through the duct 30 toward the conveying roller 42 from below, thereby suppressing a temperature rise (controlling temperature) in the sheet material. Thus effects similar to those in the first embodiment can be obtained.

It is also possible to suitably combine the aforementioned first to fifth embodiments.

The first to fifth embodiments adopt a configuration of blowing air to the sheet discharge guides, the sheet material and the conveying roller, but there may also be adopted a configuration of cooling a plurality of the members constituting the sheet material conveying mechanism (sheet discharge rollers, conveying rollers and conveying guides) in the conveying path 25, or all the members constituting the sheet material conveying mechanism (sheet discharge guides, sheet discharge rollers, conveying rollers and conveying guides).

Also in the aforementioned first to fifth embodiments, start of cooling (stopping of warm air) for the sheet material in the continuous image forming job is executed at a predetermined timing in the continuous image forming job, but such configuration is not restricted.

For example it is possible to provide a temperature detecting element for detecting the temperature of the sheet material conveying mechanism, to monitor the temperature of the sheet material conveying mechanism in the course of a job and to start the cooling of the sheet material when the detected temperature is elevated to a predetermined temperature. Also the cooling means may repeat an operated state and a non-operated state by a control apparatus so as to maintain the temperature of the sheet material conveying mechanism within a narrower temperature range in the course of a job.

This application claims priority from Japanese Patent Application No. 2004-132605 filed on Apr. 28, 2004, which is hereby incorporated by reference herein.

What is claimed is:

1. An image forming apparatus comprising:

a fixing device that heat fixes an unfixed toner image on a sheet;

a glossing device that glosses the toner image on the sheet, fixed by the fixing device, by heating during a glossing process for the toner image on one surface of the sheet;

a conveying device that conveys the sheet, on which the toner image is fixed by the fixing device, toward the glossing device; and a cooling device which cools the conveying device during successive glossing processes for a plurality of sheets so as to maintain a difference of temperature of the sheets immediately before entering the glossing device within 30° C.

2. An apparatus according to claim 1, wherein the cooling device includes a fan that blows air toward the conveying device.

3. An apparatus according to claim 1, wherein the conveying device includes a pair of rollers that nip and convey the sheet on which the toner image is fixed by the fixing device, and the cooling device cools the rollers.

4. An apparatus according to claim 1, wherein the conveying device includes a guiding plate that guides the sheet on which the toner image is fixed by the fixing device, and the cooling device cools the guiding plate.

5. An image forming apparatus comprising:

a fixing device that heat fixes an unfixed toner image on a sheet;

a glossing device that glosses the toner image on the sheet, fixed by the fixing device, by heating during a glossing process for the toner image on one surface of the sheet;

a guiding plate, disposed at a position closer to the fixing device than to the glossing device, that guides the sheet on which the toner image is fixed by the fixing device towards said glossing device; and a cooling fan that cools the guiding plate by blowing air from a side of the guiding plate opposite to a side which is contactable with the sheet.

6. An apparatus according to claim 5, wherein the guiding plate includes through holes for passing air from the cooling fan toward the sheet.

7. An apparatus according to claim 5, wherein the through holes are formed as slits along a direction inclined to a conveying direction of the sheet.

8. An apparatus according to claim 5, wherein, when successively executing the glossing process for a plurality of sheets, the cooling fan cools the guiding plate so as to maintain a temperature difference of the sheets immediately before entering the glossing device to within 30° C.

9. An image forming apparatus comprising:

a fixing device that heat fixes an unfixed toner image on a sheet;

a glossing device that glosses the toner image on the sheet, fixed by the fixing device, by heating during a glossing process for the toner image on one surface of the sheet;

a conveying device that conveys the sheet, on which the toner image is fixed by the fixing device, toward the glossing device; and a heating device which heats the conveying device during successive glossing processes for a plurality of sheets so as to maintain a difference of temperature of the sheets immediately before entering the glossing device within 30° C.

10. An apparatus according to claim 9, wherein the conveying device includes a pair of rollers that nip and convey the sheet on which the toner image is fixed by the fixing device, and the heating device heats the rollers.

11. An apparatus according to claim 9, wherein the conveying device includes a guiding plate that guides the sheet on which the toner image is fixed by the fixing device, and the heating device heats the guiding plate.

* * * * *

UNITED STATES PATENT AND TRADEMARK OFFICE

CERTIFICATE OF CORRECTION

PATENT NO. : 7,356,300 B2
APPLICATION NO. : 11/111752
DATED : April 8, 2008
INVENTOR(S) : Kamiyama It is certified that error appears in the above-identified patent and that said Letters Patent is hereby corrected as shown below:

ON THE TITLE PAGE:
At Item (56), References Cited, Foreign Patent Document, "JP 2001063890 3/2001" should read --JP 2001-63890 3/2001--, "JP 09006163 1/1997" should read --JP 9-6163 1/1997--, "JP 2003107978 4/2003" should read --JP 2003-107978 4/2003--, and "JP 2003295742 10/2003" should read --JP 2003-295742 10/2003--.

COLUMN 4:
Line 55, "necessarily" should read --necessarily be--.

COLUMN 9:
Line 22, "also" should read --also,--.
Line 32, "heat fixes" should read --heat-fixes--.

COLUMN 10:
Line 4, "heat fixes" should read --heat-fixes--.
Line 30, "heat fixes" should read --heat-fixes--.

Signed and Sealed this

Thirtieth Day of September, 2008

JON W. DUDAS
*Director of the United States Patent and Trademark Office*